United States Patent [19]

Focke et al.

[11] 4,202,151

[45] May 13, 1980

[54] APPARATUS FOR PRODUCING CIGARETTE PACKS

[75] Inventors: Heinz Focke; Kurt Liedtke, both of Verden, Fed. Rep. of Germany

[73] Assignee: Focke & Pfuhl, Verden, Fed. Rep. of Germany

[21] Appl. No.: 898,042

[22] Filed: Apr. 20, 1978

Related U.S. Application Data

[62] Division of Ser. No. 730,116, Oct. 6, 1976, Pat. No. 4,102,486.

[30] Foreign Application Priority Data

Oct. 9, 1975 [DE] Fed. Rep. of Germany ..... 2445256

[51] Int. Cl.[2] ..... B65B 7/04

[52] U.S. Cl. ..... 53/378; 53/579; 53/234

[58] Field of Search ..... 53/218, 225, 234, 377, 53/378, 579, 578; 93/12 C

[56] References Cited

U.S. PATENT DOCUMENTS

| | | | |
|---|---|---|---|
| 762,255 | 6/1904 | Rose | 53/378 X |
| 1,008,197 | 11/1911 | Richter | 53/378 X |
| 1,690,895 | 11/1928 | Fischer | 53/579 X |
| 1,962,638 | 6/1934 | Czerweny | 53/579 X |
| 2,403,047 | 7/1946 | Butterry | 229/37 R |
| 2,652,186 | 9/1953 | Zinn, Jr. | 229/37 R |
| 2,858,657 | 11/1958 | Guthrie | 53/378 X |
| 3,229,890 | 1/1966 | Wright | 229/37 R |
| 3,813,849 | 6/1974 | Stambera et al. | 53/234 |
| 3,818,675 | 6/1974 | Griner | 53/234 X |

*Primary Examiner*—John Sipos

*Attorney, Agent, or Firm*—Sughrue, Rothwell, Mion, Zinn and Macpeak

[57] ABSTRACT

An apparatus is provided for folding and sealing the longitudinal end flaps of cigarette packs. The folding is performed by means including a rotating turret having a number of radially external pockets each adapted to receive a pack. The pocket axes extend parallel to the turret axis and the pockets are open at their ends, where the end flaps which project in the intermediate folding position project out of the pocket. Folding and sealing shoes are associated with each pocket and are mounted on both sides of the turret for both radial and axial movement. Due to this movement the folding and sealing shoes first fold inwardly the longitudinal end flap—which is positioned radially inwardly relative the turret axis and which has a closure strip, in such a manner that the closure strip engages with the inside of the opposing longitudinal end flap. The shoes then apply the required pressure in the direction of its movement so that the closure strip is pressed on to the opposing longitudinal end flap, the back of which is supported by an abutment. The side end flaps are then folded by folding means applying lateral pressure.

12 Claims, 10 Drawing Figures

32
32
57
57
56
56
53
54
55
50
51
47
48
45
58
59
45
34
60
61
49
62
63

APPARATUS FOR PRODUCING CIGARETTE PACKS

This is a division of application Ser. No. 730,116, filed Oct. 6, 1976 U.S. Pat. No. 4,102,486.

The invention relates to a pack, more particularly an oblong cigarette pack, devised from a blank which is weldable or sealable at least in some of the parts of end-face end flaps—i.e., two longitudinal end flaps and two side end flaps—an internal longitudinal end flap being connected, by way of a closure strip extending along the free edge of the latter flap, to the inside of an outer longitudinal end flap, the outer longitudinal end flap being folded with the closure strip on to the top of the inner longitudinal end flap. The invention also relates to a method of making and closing a pack, more particularly near the end folding. The invention also relates to an apparatus for performing the method.

The invention relates more particularly to oblong cigarette packs, preferably to pack constructions of the kind produced from a single blank. At least some parts associated with the end foldings of the bottom and cover of the pack have a coating adapted to be activated by pressure and/or heat. One possibility which can be considered in this context in the light of practical experience is a hot melt. Alternatively the entire blank can be prepared from a foil or film or sheet or the like which has been given a coating of a hot weldable foil on one or possibly both its sides. Foils or the like of this kind are known as compound or composite foils.

The contriving and sealing-tight closure of the end folds of cigarette packs of the kind described present special problems. The folding operations must be such as can readily be performed mechanically. Also, the blank parts which have been folded on to one another in the pack end region are required to provide an aroma-tight sealing or closure of the pack with a reduced number of sticking or connecting surfaces.

The invention assumes that for the reasons mentioned parts of the end flaps which in an intermediate folding position project at the pack ends, namely the longitudinal end flaps and the side end flaps, are joined or welded to one another by the use of heat and pressure. The essence of the problem is that a sealing-tight closure calls for a particular and not too slight a pressure to be applied to the blank parts concerned, conveniently together with heat; unfortunately, the end face of the pack—i.e. the pack contents—is extremely sensitive to any such use of pressure.

It is therefore an object of the invention so to devise the pack, the method and the apparatus that a sealing-tight closure can be provided at the pack ends by the use of pressure and/or heat, yet the pressure which has to be applied does not damage the pack contents.

The invention accordingly provides a method wherein the outer longitudinal end flap and the closure strip in contact therewith are joined together, by pressure applied parallel to the plane of the end face, in an intermediate position perpendicularly to the end face. The method is of use with a very wide variety of packs, provided that they have a projecting closure strip at least at the free edge of the inner longitudinal end flap, the closure strip engaging, by way of its inside surface which has a weldable coating, with the weldable inside of the outer longitudinal end flap. In an intermediate folding position the blank parts which it is required to join together by heat and/or pressure are disposed perpendicularly to the pack end face. The necessary pressure can be produced in or parallel to the end-face plane without acting on the pack contents—since no pressure is applied perpendicularly to the end face. Appropriately high pressures and temperatures can therefore be used.

The apparatus for performing the method according to the invention has a folding and sealing element which, by means of an appropriately controlled motion, first folds inwardly the inner longitudinal end flap—which projects from the pack end face—with the closure strip and contiguous parts of the side end flaps, in such a manner that the closure strip engages with the inside of the outer longitudinal end flap. The common element then applies the required pressure in the remainder of a consistent movement pattern, so that in the direction of the movement the closure strip is pressed on to the outer longitudinal end flap and, as a result of lateral pressure, parts of the side end flaps are pressed on to one another. In this region an abutment element extends around the blank or pack so that the pressure is applied between stationary parts of the apparatus.

The folding is performed by means of or in a rotating turret having a number of radially external pockets each adapted to receive a pack. The pocket axes extend parallel to the turret axis and the pockets are open at their ends, where the end flaps which project in the intermediate folding position project out of the pocket. Folding and sealing shoes each associated with a pocket are mounted on both sides of the turret.

Embodiments of the pack and of the apparatus will be described in greater detail hereinafter with reference to the drawings wherein.

Figure 1:
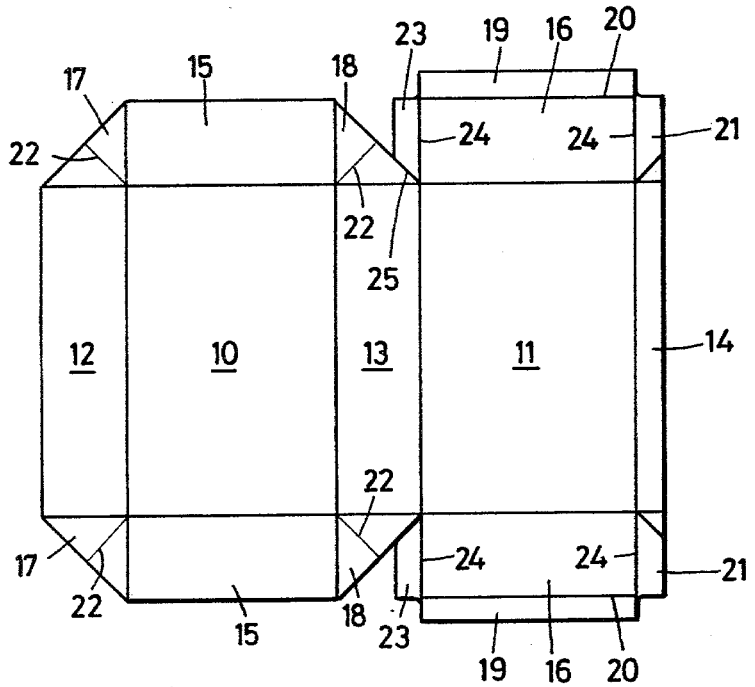
FIGS. 1 to 3 show various embodiments of a blank suitable for making up into a pack, the blank being shown spread out.
Figure 2:
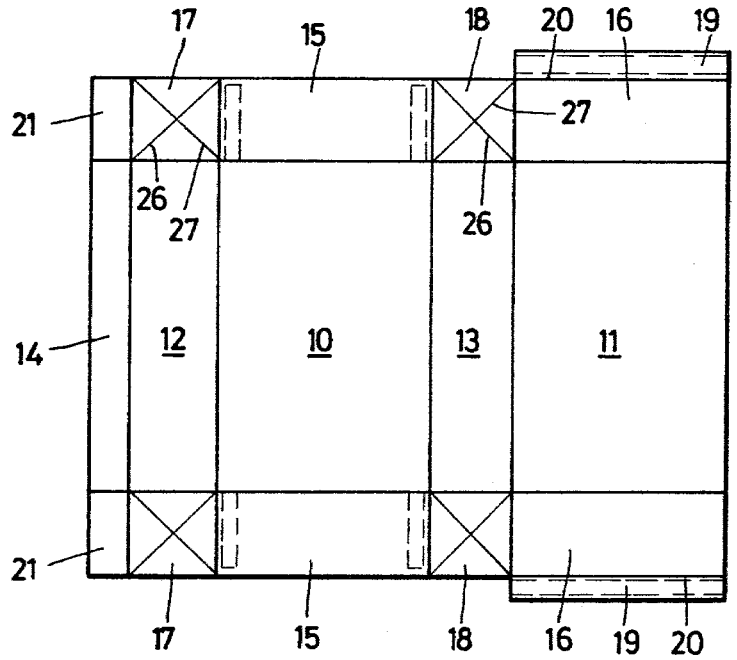
Figure 3:
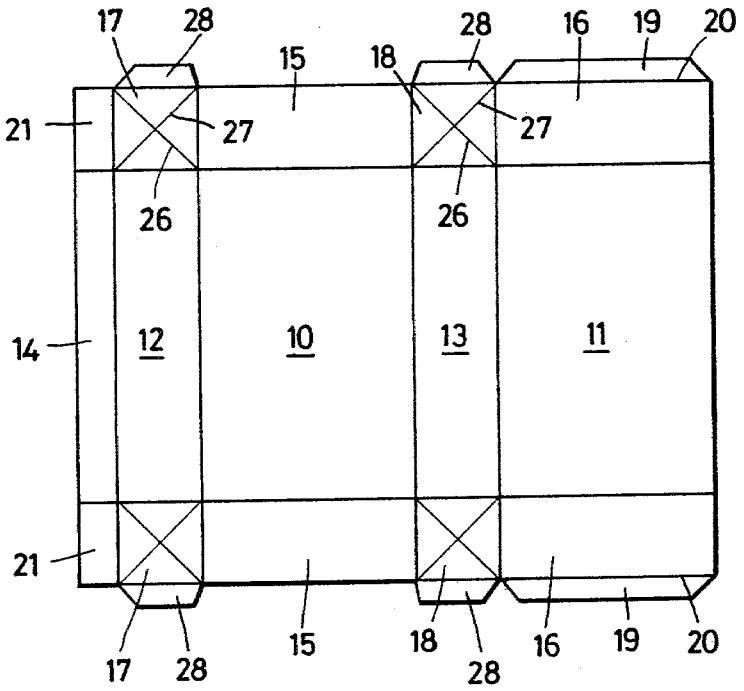

FIGS. 1 to 3 show examples of blanks suitable for making up into packs of the kind of interest for the invention, the blanks being shown spread out. All the blanks shown comprise a number of panels contrived by lengthwise and transverse fold line markings to facilitate the necessary folding. Each blank therefore comprises panels which will subsequently form a front wall 10, a rear wall 11 and side walls 12, 13. The blanks are shaped into an open-ended tube in a first intermediate folding position. Accordingly, a side strip 14 is provided at one end of the blank. In FIG. 1 the strip 14 is provided on the rear-wall panel 11 while in FIGS. 2 and 3 the strip 14 is provided on the side-wall panel 12. In the embodiment shown in FIG. 1 the strip 14 is connected to the inside of side wall 12 whereas in the embodiments shown in FIGS. 2 and 3 the strip 14 is connected to the inside of rear wall 11.

The blanks have closure flaps which project beyond the blank ends and which are folded on to the pack end face to form a pack top closure and bottom closure. The closure flaps are longitudinal end flaps 15, 16 on the front wall 10 and rear wall 11 respectively, and side end flaps 17, 18 which extend near the side walls 12, 13 respectively. In the embodiments shown the flaps 15, 16 are in all cases of a size and design such as to extend substantially over the entire pack end face. In the packs and blanks according to the invention, the longitudinal end flap 16, which is on the inside in the completely folded and closed pack and which is therefore folded directly on to the pack contents, has a closure strip 19 which extends beyond the plan area of flap 16. A fold marking 20 is the boundary between strip 19 and flap 16. Strip 19 extends over the whole length of the flap 16. In the embodiment shown in FIG. 3, the ends of strip 19 are bevelled for reasons which will become apparent hereinafter.

The side strip 14 is prolonged to near the end closure flaps—i.e. beyond the overall width of the end face—in the form of an end side strip 21. In the intermediate step of forming the blank into a tube, the strip 21 is connected to the inner longitudinal end flap 16 in FIGS. 2 and 3 or to a part of the side end flap 17 in FIG. 1.

The side end flaps 17, 18 of the embodiment shown in FIG. 1 are merely triangular gussets. The outer free end thereof extends along a diagonal. A diagonal fold line 22 is contrived perpendicularly to the latter edge near the flaps 17, 18.

On the side remote from the end side strip 21 the longitudinal end flap 16 has a strip-like portion 23 which extends over the width of flap 16 and is marked off therefrom, in just the same way as is the strip 21, by a fold line 24. Portion 23 merges into the adjacent side end flap 18 and is bounded by a diagonal fold line portion 25 which prolongs the free edge.

Figure 4:
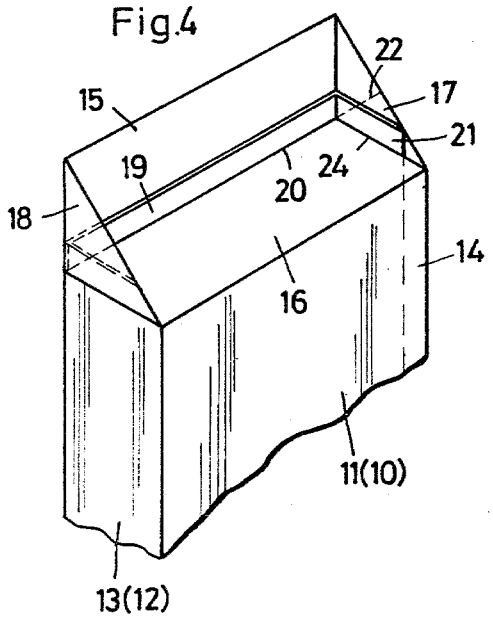
FIG. 4 is a perspective view showing the end part of a pack of the kind shown in FIG. 1 in the intermediate folding position.

When a blank of the kind shown in FIG. 1 is folded at its ends, an intermediate folding position as shown in FIG. 4 arises, where a common folding or pressing step has pressed the inner longitudinal end flap 16 of the tubular structure on to the end face of the pack or pack contents. Also, the various strips and portions 19, 21 and 23 have been folded into an upright position. These blank parts associated with the longitudinal end flap 16 are in contact by way of their (weldable) interior with the (also weldable) interior of the outer longitudinal end flap 15 and of the side end flaps 17, 18. When pressure is applied in the plane of the end face but thereabove and a corresponding external opposing pressure is applied, the blank parts 19, 21, 23 are pressed against one another and, if they have heat-weldable surface coatings, are welded together by heating. A pack which is completely sealing tight at its ends is therefore provided. In a subsequent folding step the side end flaps 17, 18 are folded inwards through the agency of the fold lines 22 and the longitudinal end flap 15 is folded outwardly on to the pack end face. All that now remains to be done is to secure the longitudinal end flap 15 and/or the side end flaps 17, 18 to the top of the longitudinal end flap 16 by tacking.

In the embodiment shown in FIG. 2, the side end flaps 17, 18 extend over the whole width of the end face. Crossing diagonal fold lines 26, 27 indicate possible ways in which the flaps 17, 18 may be folded in.

Figure 5:
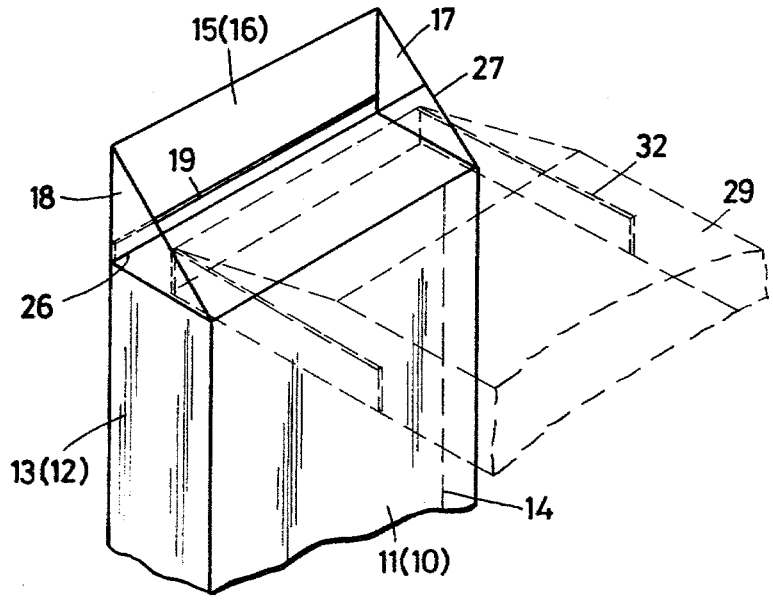
FIG. 5 is a view similar to FIG. 4 of the embodiment shown in FIG. 2, a folding and sealing shoe also being shown.

FIG. 5 shows the intermediate folding position for the blank of FIG. 2. Unlike what is shown in FIG. 4, the folding-in of the inner longitudinal end flap 16 has caused some parts—i.e., a triangular gusset—of the side end flaps 17 to be folded inwards along the diagonal fold line 26, the folded-in gusset contacting the other half of the side end flap 17, 18. In the present variant, an appropriate transverse pressure is applied to press the folded-in halves of the side end flaps 17, 18 against the outer and still unfolded halves laterally and to connect the folded-in halves to the unfolded halves, whereafter a folding step is given as in the example shown in FIGS. 1 and 4. The vertical double-walled side end flaps 17, 18 are folded inwardly along the diagonal fold line 27 and the longitudinal end flap 15 is folded on to the flaps 17, 18 and on to the longitudinal end flap 16.

The embodiment shown in FIG. 3 is very similar to the embodiment shown in FIG. 2. An additional feature is the presence near the side end flaps 17, 18 of strip-like portions 28 bevelled at their ends. When the longitudinal end flap 16 is folded inwards in the manner hereinbefore described, the portions 28 engage with the inside of the upright longitudinal end flap 15 and thus form a vertical extension of the closure strip 19. The bevelled ends of the strips 19 obviate corner overlappings. The intermediate folding position of FIG. 3 is shown again in FIG. 6.

Figure 6:
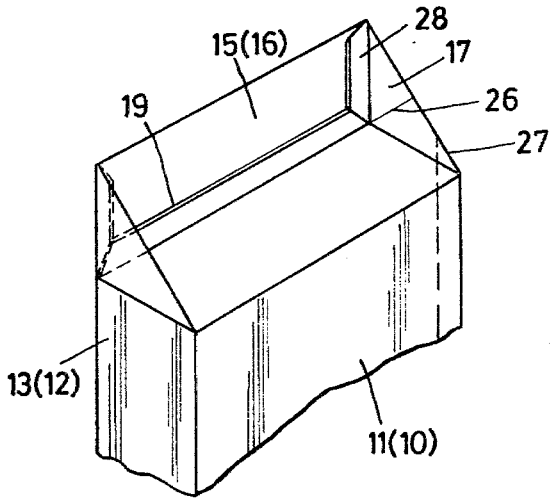
FIG. 6 is a view similar to FIG. 4 of the embodiment of FIG. 3.

The intermediate folding positions shown in FIGS. 4 to 6 are in all cases produced by a common folding and pressing step. Accordingly, a folding and sealing shoe 29 is provided; the same is advanced towards the pack end face, engages the longitudinal end flap 16 by an appropriate movement and performs the folding step described. The transverse dimensions of the shoe 29 are therefore such that the folding end of the shoe can be received appropriately in the substantially channel-section structure of the pack at the intermediate folding stage. The front end face and the side surfaces of the shoe 29 also act as pressing surfaces which press the particular blank parts concerned against the longitudinal end flap 15 and against the side end flaps 17, 18.

During this folding and pressing step the packs are retained in some way, conveniently in a pocket of a turret, the pocket having some form of abutment near the blank parts which have to be pressed against one another. Near the longitudinal end flap 15 and the side end flaps, the pocket 30 has a pressing or abutment wall 31 which is prolonged beyond the dimensions of the pack or its contents and with which the longitudinal end flap 15 and the side end flaps 17, 18 make contact. Laterally and near the longitudinal end flap 15 the wall 31 serves as a backup abutment for the shoe 29 which is introduced to produce a lateral pressure.

The shoe 29 is heatable in those of its surfaces engaging with the blank parts which it is required to join together. In the embodiment shown a heating strip or band 32 extends U-fashion around the end and side surfaces of the shoe 29. Preferably, strip 32 is heated electrically.

Figure 7:
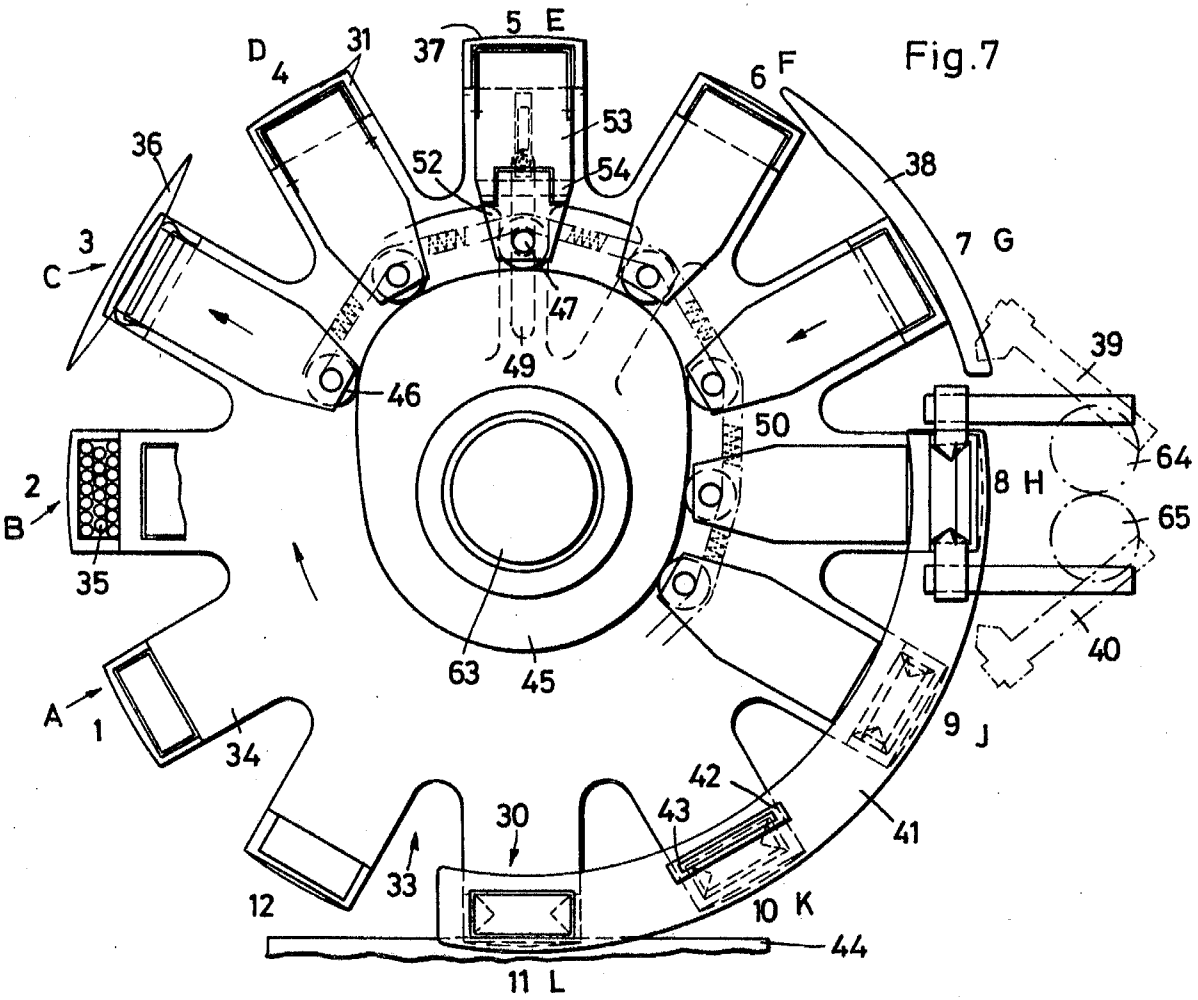
FIG. 7 is a view in diagrammatic side elevation of a turret.
Figure 8:
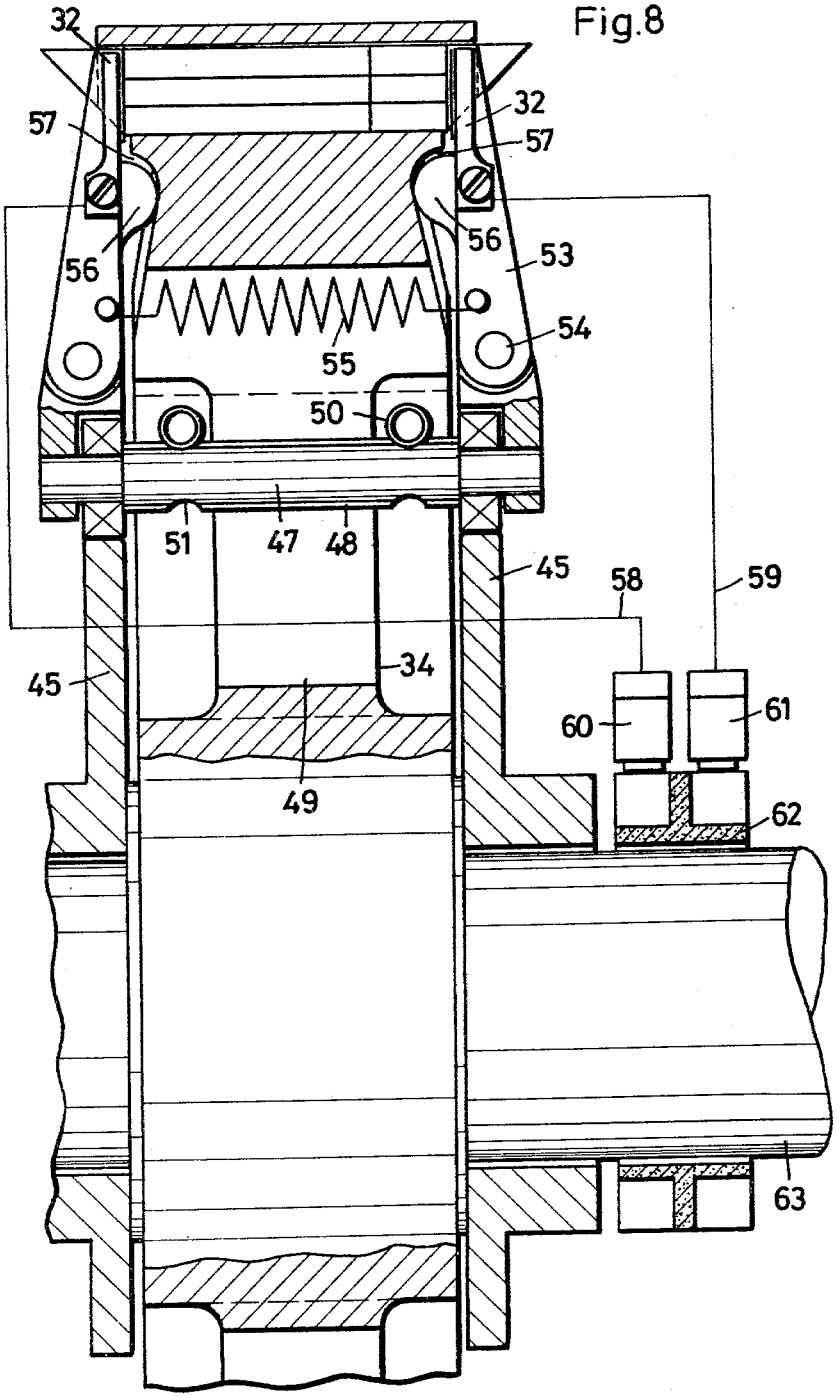
FIG. 8 is a view in radial section and to an enlarged scale through the turret of FIG. 7 near a pocket thereof.
Figure 9:
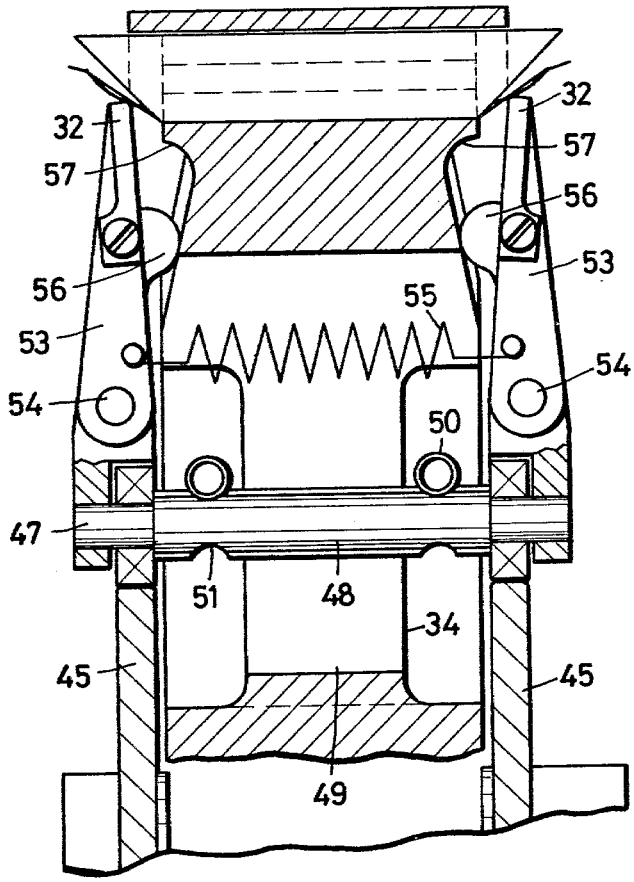
FIG. 9 is a view in radial section similar to FIG. 8 of the radially outwards part of a pocket but in a different relative position.
Figure 10:
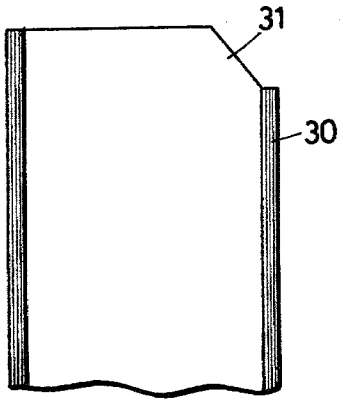
FIG. 10 is a view in side elevation and to an enlarged scale of the lateral region of a pocket.

Advantageously, a device of the kind shown in FIGS. 7 et seq can be used in the steps for folding and closing the ends of the pack.

A periodically rotating turret 33 has a number of uniformly distributed pockets 30 which are disposed in radially outwards positions and which are each adapted to receive a pack or a pack blank. The packs remain in the pockets 30 while their end closures are being contrived. As can be seen, the pockets 30 are embodied by oblong hollow members which are disposed at the ends of radial support arms 34 and which are open at their axial ends where the walls 31 serve as projecting parts of the more outwards walls of the pockets 30.

For instance, unfilled tubular blanks formed in a separate step enter the pockets at a turret station A. At a subsequent station B the pack contents, in the form of a group of cigarettes 35, are slid axially for introduction into the still open-ended—i.e., partly folded—packs. The folding steps described are then carried out at the subsequent stations.

The main folding step—i.e., the inwards folding of the longitudinal end flap 16, possibly with parts of the side end flaps 17, 18—as shown in FIGS. 4, 5 and 6 occurs either at station C or as the pocket 30 approaches station C. Associated therewith is a stationary preliminary shaper 36 which serves to prepare the end flaps 15–18 which project at the two axial ends beyond the pocket 30; the shaper 36 so projects into part of the path of the projecting end flaps 15–18 that the radially outwards and upright longitudinal end flap 15 is curved inwardly. Consequently, and as can be seen at station C, the side end flaps 17, 18 associated with the longitudinal end flap 15 are curved outwardly.

The shoe 29 is then moved appropriately so that flap 16 is folded radially outwardly on to the end face of the pack contents. The blank parts contiguous with the longitudinal end flap 16—i.e. the elements 21 and 23 (FIG. 1) or one diagonal half of the side end flaps 17 and 18—bear during the folding step on the curved parts of the side end flaps 17, 18, the latter parts being connected to the longitudinal end flap 15. The flaps 17, 18 therefore act as folding tools and fold the blank parts associated with the flap 16 into a vertical position so that the latter parts bear on the initially unfolded parts of the side end flaps 17, 18.

The shoe 29 dwells in its radially outwards position—i.e., in its position for pressing and sealing—at the next stations D–F. When the shoe 29 is in this position the parts which will subsequently form the pack closure are pressed against one another with the use of heat.

Station F is followed by a cooling station G where the radially outwards end face 37 of pockets 30, such face being curved for this purpose, moves along a stationary cooling element 38, the heat seal being cooled.

At the next station H pivoting side folders 39, 40 produce a partial inwards folding of the still vertical parts of the side end flaps 17, 18, as can be seen at station H in the drawings. Stationary folding guides 41 fixedly mounted near the pockets 30 on both sides of turret 33 are responsible for the remainder of the folding—i.e., the complete inwards folding of the side end flaps 17, 18 and the folding of the longitudinal end flaps 15 on to the end face. That surface of the guides 41 which is near the pockets 30 extends sinuously in known manner, so that as the pack rotates further, the flap 15 is folded from its upright position until it engages with the end face. The guide 41 extends over a number of stations.

Near a station K the guide 41 is formed with a recess 42 through which a heated tacking tool 43 extends. Tool 43 tacks the free edge of the outer longitudinal end flap 15 to the top of the inside longitudinal end flap 16. The tool 43 can be mounted on a swivel arm or the like not shown in detail.

At station L the completely closed pack is ejected from pocket 30 on to a conveyor 44.

The folding and sealing shoes 29 are mounted and controlled in a special way. One such shoe 29 is associated with each axial end of the pockets 30. Shoes 29 are therefore disposed on both sides of the turret 33.

The shoes 29 perform a complex compound movement as the turret rotates. Their movement is basically radial. Accordingly, the shoes 29 bear on a stationary cam 45, the shoes 29 bearing on the cam outer periphery by way of a cam follower 46. The shape of cam 45 is such that when the shoe is passing from station B to station C, shoe movement is towards the turret outer periphery, whereas when the shoe is passing from station G to station H, shoe movement is back towards the withdrawn initial position.

The shoes 29 at both ends of a pocket 30 are interconnected by a spindle 47. The cam followers 46 are mounted on the cylindrical ends of spindle 47. The central part of spindle 47, such part being disposed in the turret, is polygonal, having facets 48. By means thereof the spindle 47 is engaged, so as to be non-rotatable but movable, in a continuous radial aperture 49 in the turret 43. As can be seen, the spindles of the various shoes 29 are spring biased by two common closed annular springs 50. The same, which engage in a groove 51 in spindle 47, always press the spindles 47—and therefore the shoes 29 or their cam followers 46—on to the periphery of the cam 45. The springs 50 extend near the peripheral lateral recesses 66, 67 in the arms 34.

The shoes 29 at the ends of the spindle 47 are two-part elements, a bearing part 52 being pivotally connected to a folding and sealing part 53 by a hinge-like joint 54. The moving parts 53, which are disposed opposite one another at the pocket ends, are biased towards the pocket ends by a common tension spring 55 which extends through the turret 33 parallel to the axis thereof and near the aperture 49, the spring 55 biasing the parts 53 towards one another.

On the sides near the pockets 30 the parts 53 have protuberant guide elements 56 which contact the turret side surfaces and engage in recesses 57 therein. The same and the guide members 56 are so adapted to one another in shape that during the radial movements of the shoes 29 the part 53 thereof makes an axial movement, superimposed on the radial movement, relatively to the pockets. Consequently, the outer—i.e., the folding and pressing—ends of the parts 53 move along an arc, thus ensuring satisfactory folding.

The heating strips 32 provided in association with the pressing surfaces of the parts 53 are electrically heated. Accordingly, the strips 32 are connected by way of wiring 58, 59 and collectors 60, 61 to a slip ring 62 mounted on turret shaft 63.

The side folders 39, 40 can be devised and operated in known manner. In the embodiment shown the folding tools are pivoted together by meshing gearwheels 64, 65.

We claim:

1. An apparatus for folding the flaps of a sealable blank wrapped around a group of cigarettes in a tubular manner with the flaps projecting out beyond both ends of the group and including, at each end of the blank, an outer flap (15), side flaps (17, 18) connected to opposite sides of the outer flap, and an inner flap (16) adapted to be folded directly over the ends of the cigarettes in the group and having a sealing strip (19) on its outer edge adapted to be folded and compressively urged against the inside of the outer flap when the latter is in an upright, unfolded position, comprising:

(a) a rotatable turret (33), (b) a plurality of spaced rectangular pockets (30) radially disposed around the outer periphery of the turret, (c) each pocket being open at both ends and having its axis parallel to the turret axis, (d) a U-shaped abutment member (31) defining the outer and lateral side walls of each pocket and extending out beyond both opposite ends of a group of cigarettes wrapped in a tubular blank and disposed in said pocket, (e) the outer flaps (15) and the side flaps (17, 18) bearing against the walls defined by the abutment member, (f) a pair of radially disposed sealing shoes (29) slidably mounted on opposite sides of the turret adjacent the open ends of each pocket and transversely movable relative to the pocket axis to individually fold an upright inner flap against the ends of the groups of cigarettes and to simultaneously fold the sealing strip attached to the outer edge of said inner flap and compressively urge said strip against the inside of an upright outer flap bearing against said abutment member, and (g) means for radially moving said sealing shoes both towards and away from the pockets at predetermined times during the rotation of said turret.

2. An apparatus according to claim 1, wherein the sealing shoes (29) are adapted to be advanced along an arcuate path of movement to the inner flaps.

3. An apparatus according to claim 2, wherein pressing surface of each sealing shoe (29) are electrically heated.

4. An apparatus according to claim 1, wherein the sealing shoes bear against stationary cams (45) and are biased into engagement therewith by common ring spring means (50).

5. An apparatus according to claim 4, wherein the sealing shoes are controlled by guide members (56) to perform arcuate folding and pressing movements.

6. An apparatus according to claim 5, wherein the sealing shoes engage shaped recesses (57) of the pockets having bearing surfaces for the guide members.

7. An apparatus according to claim 5, wherein the sealing shoes are pivotally connected to a bearing member (52) and are urged together by a tension spring (55).

8. An apparatus according to claim 7, wherein each pair of sealing shoes is mounted on a common spindle (47) which extends parallel to the pocket axis and which can move radially in the turret.

9. An apparatus according to claim 8, wherein the spindle (47) is guided in a radial aperture (49) of a support arm (34) of the turret.

10. An apparatus according to claim 8, wherein cam followers (46) rotatably mounted on the spindle (47) engage the cams (45).

11. An apparatus according to claim 10, wherein the side flaps are folded toward the inner flap (16) by side folders adapted to move laterally.

12. An apparatus according to claim 11, wherein the side flaps and the outer flap (15) are folded onto the ends of the group of cigarettes by a stationary folding guide on both sides of the turret.

* * * * *